United States Patent [19]

Switlicki

[11] Patent Number: 4,710,609

[45] Date of Patent: Dec. 1, 1987

[54] PROCESS FOR HEATING HAIR CURLERS BY MICROWAVE ENERGY

[76] Inventor: Michael Switlicki, 3330 Rabidue Rd., Goodells, Mich. 48027

[21] Appl. No.: 844,965

[22] Filed: Mar. 27, 1986

[51] Int. Cl.[4] ..... A45D 2/00; H05B 1/00; H05B 6/64

[52] U.S. Cl. ..... 219/222; 132/7; 132/9; 132/11 R; 132/33 R; 132/39; 219/10.55 R; 219/10.55 E

[58] Field of Search ..... 219/222–226, 219/10.55 R, 10.55 E; 132/7, 9, 11 R, 33 R, 39

[56] References Cited

U.S. PATENT DOCUMENTS

| | | | |
|---|---|---|---|
| 1,510,359 | 9/1924 | Van Gale | 219/222 X |
| 4,453,554 | 6/1984 | Caruso | 132/33 R |
| 4,516,011 | 5/1985 | Jeffress et al. | 132/33 R |
| 4,520,832 | 6/1985 | Skovdal | 132/36 R |
| 4,526,184 | 7/1985 | Caruso | 132/39 |
| 4,538,630 | 9/1985 | Henderson | 132/33 R |

*Primary Examiner*—Anthony Bartis
*Attorney, Agent, or Firm*—John R. Benefiel

[57] ABSTRACT

A process for heating a hollow hair curler having walls constructed of a plastic material transparent to microwave and impermeable to water vapor and containing a mass of wicking material, such as an open cell form rubber, permeable to microwave energy including (1) dispersing a quantity of water into the wicking material through a filling hole at an end of the curler and (2) subjecting the curler to microwave energy in a conventional microwave oven to heat the water dispersed in the wicking material and thereby heat the curler. The filling hole is left open to provide a vent allowing escape of steam to insure that excessive pressures are not generated within the curler during the heating process.

2 Claims, 3 Drawing Figures

PROCESS FOR HEATING HAIR CURLERS BY MICROWAVE ENERGY

BACKGROUND OF THE INVENTION

1. Field of the Invention

The present invention concerns hair curlers and more particularly processes and arrangements for heating hair curlers prior to their use.

2. It is often desirable to heat hair curlers prior to use for more effective hair curling. There have been provided many methods of heating hair curlers. The most common method is placing the hair curlers, which are generally shaped as hollow cylinders, over metal posts which posts are electrically heated to thereby heat the hair curler body. While this method is effective, it does require a number of minutes for the hair curlers to reach the desired temperature.

Other such arrangements have heretofore been developed. U.S. Pat. No. 4,499,355, discloses the use of induction heating of hair curlers, in which a steel cylinder having a high permeability to electricity is heated by a surrounding induction coil. A similiar arrangement is shown in U.S. Pat. No. 3,760,148.

U.S. Pat. No. 3,410,985, discloses the use of water as a heat storing substance with a quantity of water disposed within the curler and heated by a rod in contact with electrical heater elements on a heating plate.

It has also heretofore been known to use steam heating of foam core curlers as disclosed in U.S. Pat. No. 4,516,011.

U.S. Pat. No. 4,520,832, uses hollow cores of another wicking material such as black felt for releasing steam heated by a cylinder inserted over a conventional hair curler heating post.

U.S. Pat. No. 4,298,787, teaches steam heating of hair curlers in which the steam is generated by a heating element.

U.S. Pat. No. 4,453,554, uses foam cores on hair curlers which are arranged to absorb steam introduced at one end.

Each of these arrangements suffers from a disadvantage of requiring specialized, relative complex apparatus or are relatively slow in their heating action. It would be advantageous to provide a very rapid heating of hair curlers without requiring specialized, costly heating apparatus.

Accordingly, it is an object of the present invention to provide a process and arrangement for very rapidly heating hair curlers without necessitating the use of complex, specialized heating equipment, or necessitating complex, expensive hair curler construction.

SUMMARY OF THE INVENTION

This and other objects which will become apparent upon reading the following specification and claims are achieved by a hair curler having a plastic, generally cylindrical body having an internal cavity with a body of open-cell foam wicking material.

A quantity of water is dispersed through the wicking material and the hair curler carrying the dispersed water is subjected to microwave radiation which penetrates the hair curler body and causes rapid, intense heating of the quantity of water to thereby quickly heat the hair curler body.

A conventional microwave ovens may be employed to provide a convenient source of microwave radiation to thus not necessitate a special heating apparatus.

The hair curler may be constructed with an opening formed through one end cap with the body of open cell foam utilized as the wicking material. A longitudinally extending bore formed in the foam body enables water to be readily added to the hair curler as required to make up losses occuring during use, while venting the interior of the curler to prevent a high pressure build-up in the curler during heating.

DETAILED DESCRIPTION

In the following detailed description, certain specific terminology will be employed for the sake of clarity in a particular embodiment described in accordance with the requirements of 35 USC 112, but it is to be understood that the same is not intended to be limiting and indeed should not be so construed inasmuch as the invention is capable of taking many forms and variations within the scope of the following of the appended claims.

Figure 1:
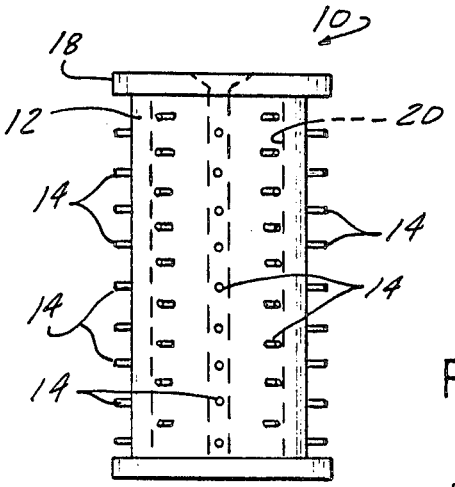
FIG. 1 is a front elevational view of a hair curler according to the concept of the present invention.
Figure 2:
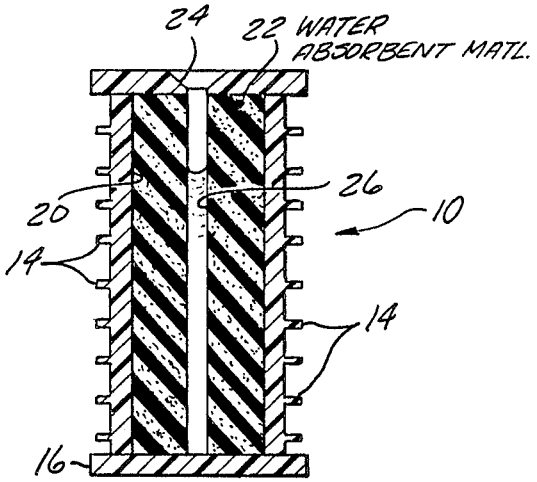
FIG. 2 is a transverse sectional view of the hair curler shown in FIG. 1.
Figure 3:
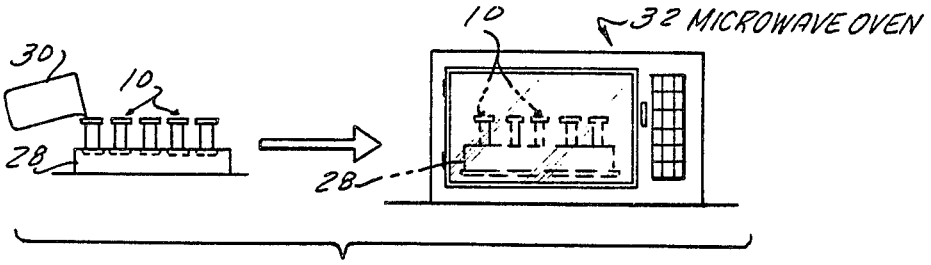
FIG. 3 is a diagrammatic representation depicting the process of heating the hair curlers, shown in FIGS. 1 and 2, in a microwave oven.

Referring to the drawings, and particularly FIGS. 1 and 2, the hair curler 10 is a generally cylindrical body portion 12 being formed with a plurality of projections 14 adapted to engage the hair tresses in a manner well known to those skilled in the art. The body portion 12 is preferably formed of suitable molded plastic, such as to allow microwave radiation to pass freely through without heating.

The hair curler body is provided with a pair of end caps 16 and 18 at either end thereof. Which together with the hollow cylindrical body 12 forms a interior cavity 20.

Situated within the cavity 20 is a body of wicking material 22, which is of a substance which allows passage of microwave radiation therethrough, thereby allowing heating of water contained therein. Such a body 22 could be constructed of a molded plastic material to achieve this end.

According to the concept of the present invention, a quantity of water is able to be disposed in the cavity by being dispersed throughout a mass of wicking material comprised by generally cylindrical body 22. For this purpose, open cell foam rubber has been found to be a suitable material.

Prior to being subjected to microwave radiation, a sufficient quantity of water may be added conveniently to be dispersed in the wicking body 22 by means of a flared hole 24 formed in the upper end-cap 18 and a longitudinally extending bore 26 formed through the wicking body 22.

Longitudinal bore 26 is preferably of relatively narrow diameter, i.e., ⅛th of an inch, to insure rapid absorbtion of water into body 22. Thus water may easily be introduced by the funnel action of the flared hole opening 24, thence passing into the longitudinal bore 26, and thereafter migrating into the wicking body 22, such that a quantity of water will be dispersed therein.

According to the concept of the present invention, a number of hair curlers 10 may be carried in a holder 28, each having its upper end cap 18 disposed upwardly. Water is added as necessary to each hair curler 10, introduced into the flared hole 24 from a suitable container 30.

Thereafter the curlers 10 and holder 28 are placed within a conventional microwave oven 32 wherein they are subjected to microwave radiation. Such microwave radiation will rapidly and intensely heat the water dispersed in the wicking body 22 and thereby heat the hair curler 10 itself. Flared hole 24 vents the cavity space 20 of each hair curler 10, and allows the escape of water vapor generated during heating, to thereby insure that excessive pressures will not be generated in the hair curlers 10.

Thus a very rapid, convenient heating of the hair curlers may be accomplished by the use of conventional household equipment, i.e., a microwave oven. The hair curlers and holder being extremely simple may be constructed economically and sold at a moderate price.

A certain amount of water may escape by evaporation, particularly during the heating cycles but can be conveniently and quickly replenished prior to each heating cycle.

It can be appreciated that the above-recited object of the present invention is achieved by the arrangement and process described, in that convenient heating of hair curlers may be achieved very quickly, i.e., in a matter of seconds compared to the several minutes required by conventional heating methods and arrangements. Furthermore the hair curler construction is simplified and made more economical and at the same time specialized heating apparatus is not required.

I claim:

1. A process of heating hair curlers constructed of a material through which microwaves may pass comprising the steps of:

positioning a mass of wicking material within a cavity in a hair curler constructed of a material transparent to microwave energy and configured to be impermeable to water vapor along the sides thereof, said wicking material being constructed of a material which allows the passage of microwave energy therethrough;

dispersing a quantity of water into said mass of wicking material contained in said cavity;

subjecting said hair curler with said dispersed quantity of water to microwave radiation to heat said quantity of water and thereby heat said hair curler.

2. The process according to claim 1 further including the step of providing said hair curler with vent means communicating with said cavity for allowing the escape of water vapor from the cavity insuring that excessive pressure will not be generated within said hair curler when the hair curler is subjected to microwave radiation.

* * * * *